United States Patent [19]

Meadows

[11] 4,327,522

[45] May 4, 1982

[54] ASSEMBLY FOR ACTUATION OF OPENABLE CLOSURE LID

[75] Inventor: William W. Meadows, Winnipeg, Canada

[73] Assignee: Westeel-Rosco Limited, Toronto, Canada

[21] Appl. No.: 94,330

[22] Filed: Nov. 13, 1979

[51] Int. Cl.[3] ..... E05F 11/04

[52] U.S. Cl. ..... 49/279; 49/345; 49/347; 49/357

[58] Field of Search ..... 49/279, 345, 302, 357, 49/394, 347, 386, 356; 52/192, 72; 220/264, 334

[56] References Cited

U.S. PATENT DOCUMENTS

| | | | |
|---|---|---|---|
| Re. 28,755 | 4/1976 | Hege | 49/357 X |
| 331,024 | 11/1885 | Bate | 49/345 X |
| 352,818 | 11/1886 | Harbort | 49/347 |
| 537,830 | 4/1895 | Kneen | 49/347 |
| 598,975 | 2/1898 | Burger | 49/347 |
| 622,363 | 4/1899 | Hoskins | 49/279 |
| 706,829 | 8/1902 | Johnson | 49/279 |
| 925,555 | 6/1909 | Blickley | 49/279 |
| 1,494,290 | 5/1924 | Ruhmann | 49/347 X |
| 1,606,621 | 11/1926 | Fischer | 49/347 |
| 1,746,556 | 2/1930 | Preston | 49/356 X |
| 1,950,059 | 3/1934 | McNeil | 49/357 X |
| 3,733,750 | 5/1973 | Hege | 49/379 |
| 3,961,660 | 6/1976 | Vinci | 49/345 X |
| 4,208,839 | 6/1980 | Candy, Sr. | 49/357 |

*Primary Examiner*—Philip C. Kannan

*Attorney, Agent, or Firm*—Ridout & Maybee

[57] ABSTRACT

There is provided an assembly for opening and closing a closure lid of a grain bin or silo from a remote position, such as ground level. When a flexible cord or cable connected to the upper end of a lower lever is operatively pulled there is relative pivotal movement between this lower lever and an upper lever against the influence of a spring acting therebetween, with a latch arm the upper end of which is pivotally connected through an operating arm to the upper end of the upper lever being initially pivotted relative to the closure lid to move a latch member presented by the latch arm out of engagement with a fixed bracket member with resilient deformation of a relatively stiff but resiliently deformable strip connected between the closure lid and the operating arm. Thereafter, the closure lid is pivotally raised about a fixed pivot axis thereof. Releasing of the cord or cable results in the closure lid being urged under the influence of the spring pivotally to be lowered to its closed condition.

5 Claims, 5 Drawing Figures

Figure 3:
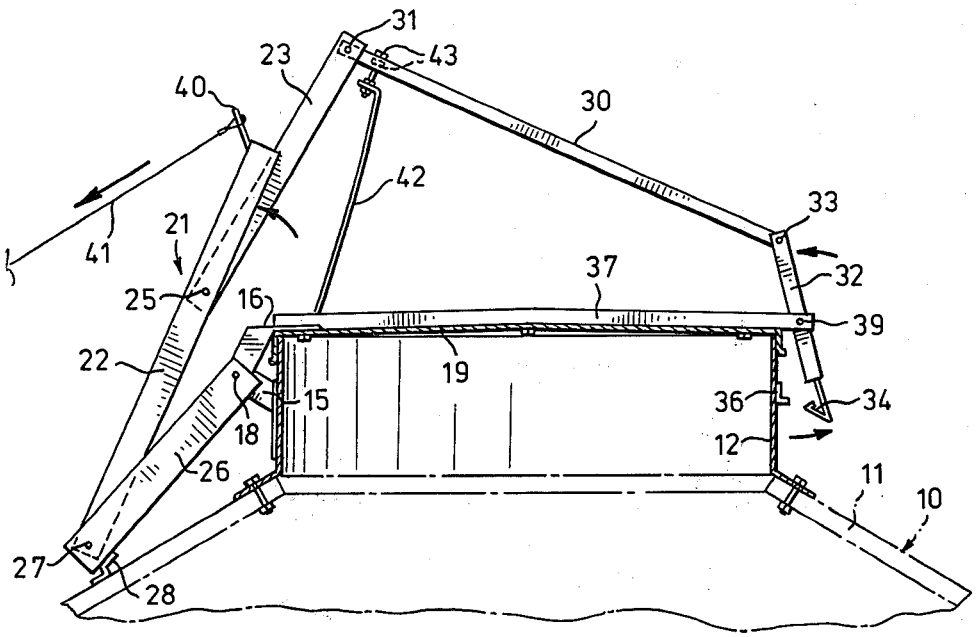

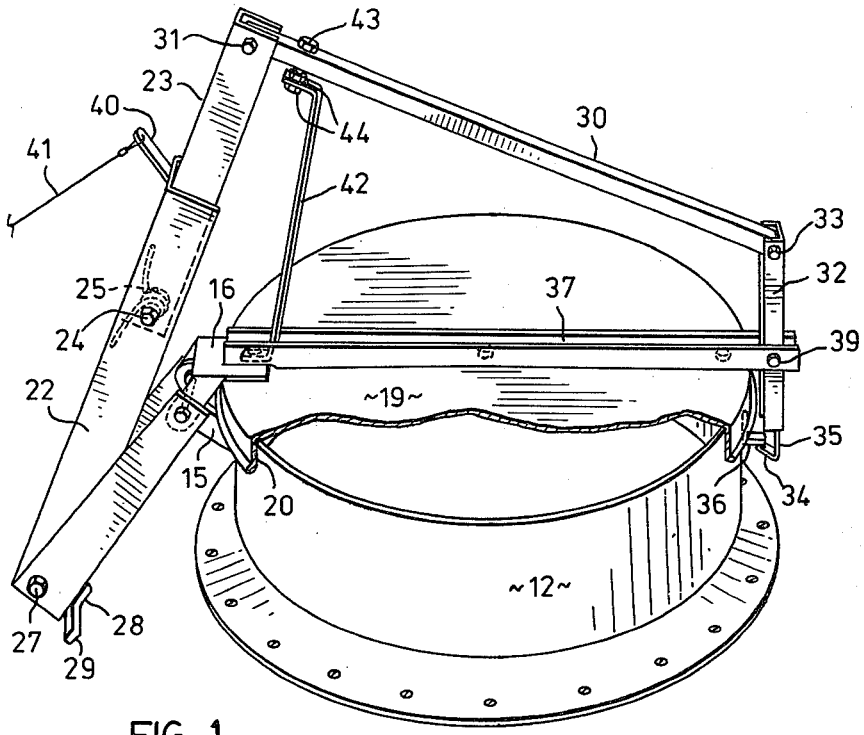
FIG. 1
FIG. 2
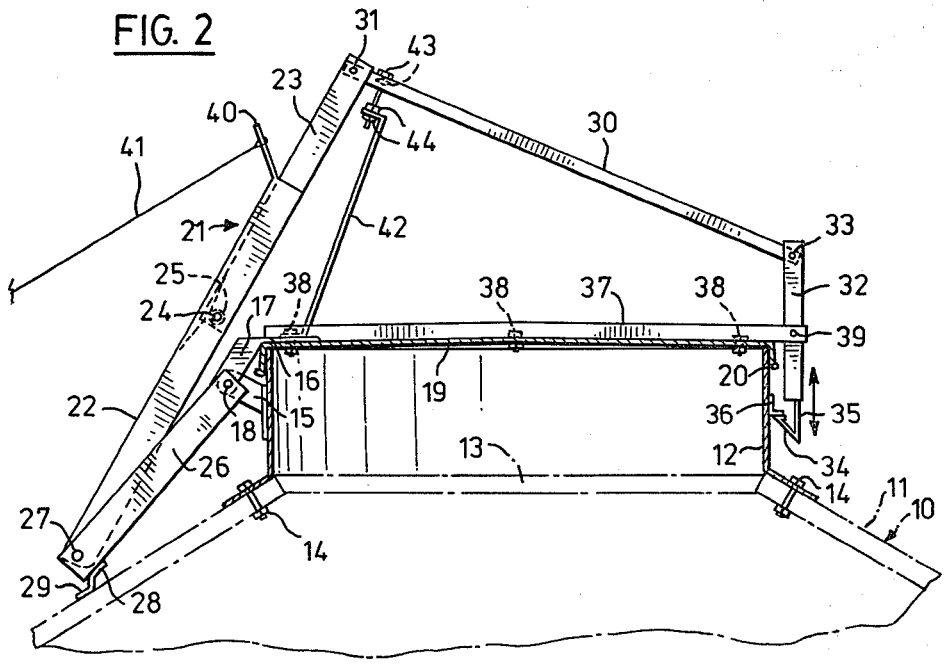

ASSEMBLY FOR ACTUATION OF OPENABLE CLOSURE LID

This invention is concerned with an assembly for actuation of an openable closure lid, and more particularly although not exclusively with such an assembly for actuation of an openable closure lid of a grain bin or silo.

A grain bin or silo conventionally comprises upstanding side walls which are generally of cylindrical form and which bound a chamber within which the grain is operatively stored, the grain bin or silo usually having a top wall of frusto-conical form with an upstanding collar being provided around the central opening in the top wall and with a closure lid being provided for closing the upper end of this collar. The lid which is usually pivotally mounted about one side thereof to the collar is movable between a closed position in which it prevents the entrance of, for example, rain to the interior of the grain bin or silo and a fully open position in which it permits the discharge of grain through the upstanding collar into the bin or silo. Furthermore, it is frequently desirable for the lid to be opened to an intermediate position between the closed and the fully open positions to permit venting of the interior of the bin or silo in order, for example, to permit the discharge of gases which may accumulate within the bin or silo.

Such grain bins or silos are generally of considerable height, and it is accordingly inconvenient and potentially dangerous if it is necessary for the operator to climb onto the top wall of the bin or silo whenever it is required that the lid be moved between any of the above-described closed, fully open and intermediate venting positions.

It is a primary object of the present invention to provide an improved assembly for actuation of an openable closure lid in which this actuation can be performed by an operator at a location remote from the closure lid as, for example, by an operator at ground level where the lid is provided on a grain bin or silo as hereinbefore described.

According to the present invention there is provided an assembly for actuation of an openable closure lid, the assembly comprising a closure lid pivotally mounted about a fixed pivot axis for pivotal movement between a closed position and a raised open position, a lever member having a lower end portion pivotally mounted about a fixed pivot axis and having an upper end portion, n operating arm having a first end portion and a second end portion with said first end portion being pivotally connected to the upper end portion of the lever member, stiff but resilient means interconnecting the closure lid and the operating arm for resiliently urging the operating arm relative to the closure lid in the direction of the second end portion of the operating arm during pivotal movement of the closure lid between the closed and open positions thereof, and a latch arm having an upper end portion and a lower end portion with said upper end portion of the latch arm being pivotally connected to the second end portion of the operating arm and with a latch member being presented by the lower end portion of the latch arm. The lever member comprises a lower lever and an upper lever which is pivotally connected to the lower lever, the levers having respective abutment portions which, in a limit condition of the levers, are in contact to limit relative pivotal movement between the levers in a direction in which the upper lever pivots relative to the lower lever away from the operating arm, spring means acting between the levers resiliently to urge the levers towards said limit condition thereof. The latch arm is pivotally connected to the closure lid at a spaced distance from the fixed pivot axis of the closure lid, and the latch member when the closure lid is in the closed position thereof is engageable with a fixed member adapted to be provided below the closure lid. A flexible member is connecred to the lower lever for pivotal movement thereof about the fixed pivot axis of the lever member.

Figure 4:
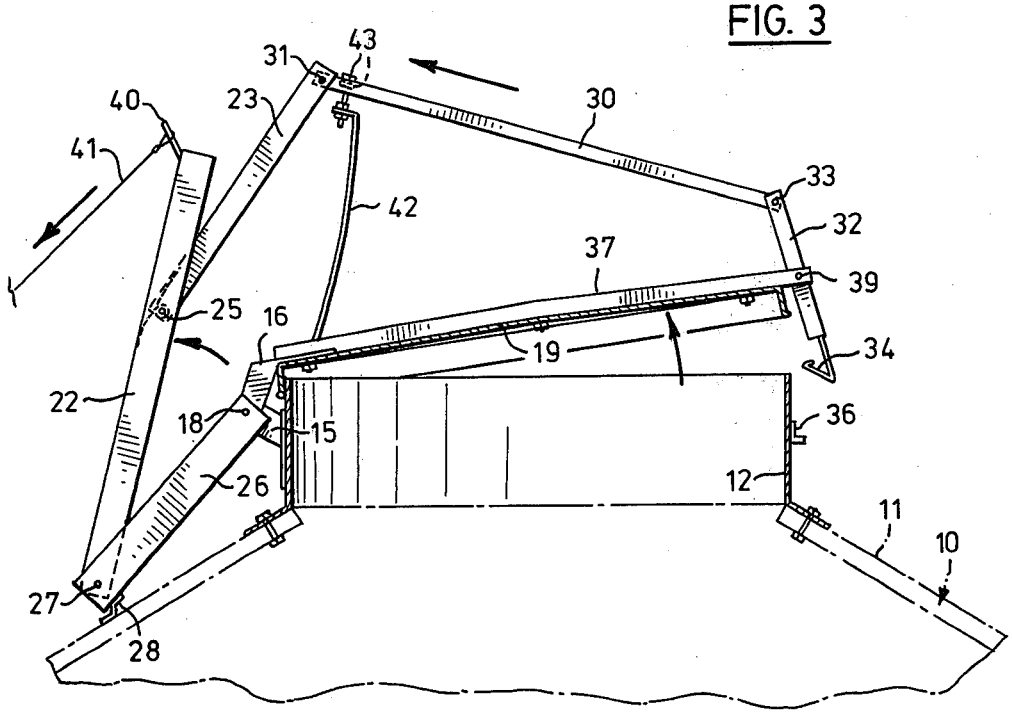
Figure 5:
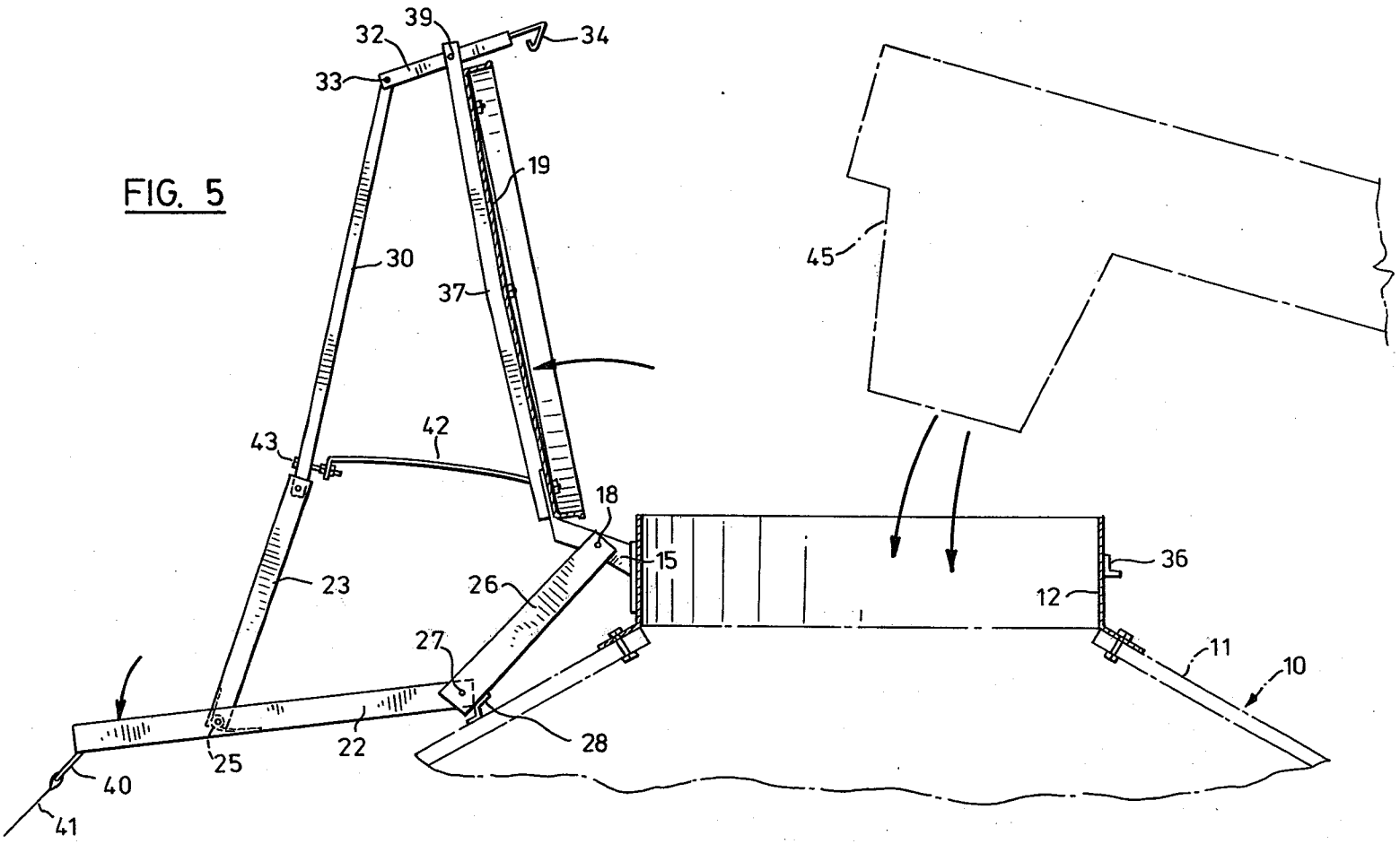

In order that the invention may be more clearly understood and more readily carried into effect the same will now, by way of example, be more fully described with reference to the accompanying drawings in which FIG. 1 is a partly broken-away view of an assembly according to a preferred embodiment of the invention;

FIG. 2 is a side view partly in section of the assembly shown in FIG. 1, the view showing the assembly with the closure lid in the closed position thereof; and FIGS. 3, 4 and 5 are side views corresponding to FIG. 2, but showing the assembly in different operative conditions thereof.

Referring to the drawings, 10 denotes generally a grain bin or silo comprising a cylindrical side wall (not shown) which may be formed of a plurality of interconnected metal sheets of corrugated form. 11 denotes a top wall of the bin or silo 10, this top wall 11 which is shown in FIGS. 2 to 5, inclusive, in chain-dotted lines being of frusto-conical form with the outer edge thereof secured to the top edge portion of the cylindrical side wall and with an upstanding cylindrical collar 12 being provided around the central opening 13 in the top wall 11. The lower edge portion of the collar 12 is secured as, for example, by nut and bolt assemblies 14 to the inner edge portion of the top wall 11 surrounding the opening 13. A bracket 15 is fixedly secured to the collar 12 with a lug 16 having bifurcated leg portions 17 straddling the bracket 15 and being pivotally connected thereto by means of a pivot pin 18. The lug 16 is fixedly secured to one side of a closure lid 19 which in a closed position thereof (FIGS. 1 and 2) closes the upper end of the collar 12 with a downwardly projecting flange portion 20 of the closure lid 19 surrounding the upper edge portion of the collar 12.

As hereinbefore described with reference to the accompanying drawings the grain bin or silo 10 is of conventional form.

According to the present invention there is provided an assembly comprising a lever member 21 which is constituted by a lower lever 22 and an upper lever 23, each of the levers 22 and 23 being of channel form in cross-section with the lower portion of the upper lever 23 disposed within the upper portion of the lower lever 22 and with a pivot pin 24 disposed through the side walls of the upper lever 23 adjacent the lower end thereof and through the adjacent side walls of the lower lever 22. It will be appreciated that the lower and upper levers 22, 23 are relatively pivotable about the pivot pin 24 from a limit condition thereof in which the lower end portion of the web of the upper lever 23 is in contact with the upper end portion of the web of the lower lever 22, the lower end portion of the web of the upper lever 23 and the upper end portion of the web of the lower lever 22 thus constituting abutment portions which are in contact when the levers 22, 23 are in the above-mentioned limit condition thereof. A spring 25 which is disposed around the pivot pin 24 and the ends of which bear against the lower end portion of the web of the upper lever 23 and against the upper end portion of the web of the lower lever 22, respectively, serves resiliently to urge the levers 22, 23 towards said limit condition thereof.

A member 26 of channel form in cross-section is provided, the upper end of this member 26 being pivotally mounted about the pivot pin 18 and the lower end of the member 26 being pivotally connected by a pivot pin 27 which is disposed through the side walls of the lower lever 22 to the lower end of this lever 22. The lower end portion of the web of the member 26 presents a bracket 28 having a support portion 29 which operatively bears against the frusto-conical top wall 11 of the bin or silo 10, the upper end portion of the web of the member 26 being slotted to accommodate the bracket 15. As will be appreciated the pivot axes presented by the pivot pins 18 and 27 are fixed pivot axes.

An operating arm 30 is disposed with a first end portion thereof pivotally connected by means of a pivot pin 31 to the upper end of the upper lever 23. An upper end of a latch arm 32 of channel form in cross-section is pivotally connected about a pivot pin 33 to a second end portion of the operating arm 30, a latch member 34 which is in the form of an inwardly projecting tooth being provided at the lower end of a plate 35 which is adjustably bolted within the lower end portion of the latch arm 32. Thus, by adjustment of the bolted connection between the plate 35 and the latch arm 32 the position of the latch member 34 can be varied so that with the assembly in the condition shown in FIG. 2 in which the closure lid 19 is in the closed position thereof the latch member 34 is in engagement beneath a fixed bracket member 36 secured below the closure lid 19 to the collar 12 on the side thereof opposite the bracket 15.

An upwardly open channel member 37 is secured by nut and bolt assemblies 38 across the top of the closure lid 19 with an end portion of the member 37 extending beyond the lid 19, the latch arm 32 being pivotally mounted intermediate its ends to this extending end portion of the member 37 by means of a pivot pin 39.

the upper end of the lower lever 22 presents a lug 40 to which is attached one end of a flexible member 41 such as a cord or cable, the other end of this flexible member 41 being operatively disposed at, for example, ground lever for operation of the assembly by an operator, as is hereinafter more fully described.

Stiff but resilient means constituted by a relatively stiff but resiliently deformable strip 42 is provided, the lower end portion of this strip 42 being secured to the member 37 at the lug 16 by one of the nut and bolt assemblies 38, and the upper end portion of the strip 42 being secured, preferably adjustably, to the operating arm 30 adjacent the upper end of the upper lever 23 thereby to support the operating arm 30. This adjustable securement of the upper end portion of the strip 42 preferably comprises a nut and bolt assembly 43 the bolt of which is disposed through an opening in the operating arm 30 and through an opening in the upper end portion of the strip 42 with lock nuts 44 which are screw-threadedly mounted on the bolt of the assembly 43 securing the upper end portion of the strip 42 thereto.

With the assembly in the condition shown in FIG. 2 in which the closure lid 19 is in the closed position thereof and the latch member 34 is in engagement with the fixed bracket member 36, pulling on the flexible member 41 by an operator located, for example, at ground level causes pivotal movement of the lower lever 22 about the pivot pin 27 with pivotal movement of the upper lever 23 about the pivot pin 24 relative to the lower lever 22 and against the influence of the spring 25. This pivotal movement of the upper lever 23 results in movement of the operating arm 30 to cause pivotal movement of the latch arm 32 about the pivot pin 39 initially to disengage the latch member 34 from the fixed bracket member 36 (FIG. 3). The above-described movement of the operating arm 30 results in resilient deformation of the strip 42.

Continued pulling on the flexible member 41 results in continued pivotal movement of the lower lever 22 about the pivot pin 27 with continued pivotal movement of the upper lever 23 against the influence of the spring 25 about the pivot pin 24. This continued pivotal movement of the upper lever 23 results in continued movement of the operating arm 30, but because of the relatively stiff nature of the strip 42 the quadrilateral constituted by the operating arm 30, the upper portion of the latch arm 32 between the pivot pins 33 and 39, the closure lid 19, and the strip 42 constitutes a substantially fixed quadrilateral during the above-mentioned continued movement of the operating arm 30, so that during this continued movement of the operating arm 30, the closure lid 19 is pivotally raised about the pivot pin 18 through an intermediate venting position (FIG. 4) to a fully open position (FIG. 5) in which the discharge end portion 45 (shown in chain-dotted lines) of a grain conveying mechanism may be disposed for discharge of grain into the bin 10.

As the flexible member 41 is released, the above-described operations are performed in reverse and in the reverse sequence. Thus, as the flexible member 41 is released the closure lid 19 is pivotally lowered about the pivot pin 18 through the intermediate position (FIG. 4) to the position shown in FIG. 3, the above-mentioned quadrilateral constituted by the operating arm 30, the portion of the latch arm 32 between the pivot pins 33 and 39, the closure lid 19, and the strip 42 consituting a substantially fixed quadrilateral during this pivotal lowering of the closure lid 19 about the pivot pin 18. Thereafter, continued releasing of the flexible member 41 results in pivotal movement of the latch arm 32 about the pivot pin 39 to re-engage the latch member 34 beneath the fixed bracket member 36 as the resiliently deformed strip 42 returns to its initial condition.

Thus, during opening of the closure lid 19 the latch member 34 initially disengages from the fixed bracket member 36 before pivotal movement of the closure lid 19 about the pivot pin 18 commences, and conversely during closing of the closure lid 19 the closure lid 19 is initially pivotally lowered about the pivot pin 18 to the closed position thereof before the latch member 34 moves for re-engagement thereof beneath the fixed bracket member 36.

From the above description of the preferred embodiment of the present invention and of its operation it will be noted that the spring 25 in resiliently urging the levers 22, 23 towards the hereinbefore described limit condition thereof constantly urges the closure lid 19 towards its closed condition. Thus, an the flexible member 41 is released the influence of the spring 25 causes the closure lid 19 to be pivotally lowered as hereinbefore described, even if, as shown in FIG. 5, the center of gravity of the assembly is disposed on the opposite side of a vertical plane through the pivot pin 18 from the lid 19 when in its closed condition, i.e. to the left of this vertical plane as viewed in the drawings. Likewise, as the flexible member 41 is released the influence of the spring 25 causes the closure lid 19 to be pivotally lowered, even if there is a wind force urging the closure lid 19 pivotally to move in the opposite direction. It is also to be noted that if for any reason the latch member 34 fails to engage beneath the bracket member 36 when the assembly is in the condition shown in FIG. 2 the closure lid 19 is nevertheless resiliently maintained in its closed condition under the influence of the spring 25.

It will be appreciated that the member 26 in the above-described preferred embodiment of the invention may be omitted, although in this case it will be necessary for the pivot pin 27 to be supported in a bracket which is fixedly secured as, for example, by welding, riveting, bolting or the like to the top wall 11.

In the preferred embodiment as hereinbefore described the adjustable securement of the strip 42 constituted by the nut and bolt assembly 43 and the lock nuts 44 accommodates manufacturing tolerances in the dimensions of the various elements constituting the assembly, and also permits variation in the degree of resiliency in the strip 42 thereby to permit variation in the degree of pivotal movement of the latch arm 32 before pivotal movement of the closure lid 19 about the pivot pin 18 commences. As will be appreciated, the adjustable securement constituted by the nut and bolt assembly 43 and the lock nuts 44 may if desired be provided at the connection between the strip 42 and the closure lid 19 instead of at the connection between the strip 42 and the operating arm 30, or of course such an adjustable securement may be provided both at the connection between the strip 42 and the closure lid 19 and at the connection between the strip 42 and the operating arm 30. The provision of the stiff but resilient means constituted by the strip 42 confers on the assembly a stability which is not achieved if this strip 42 is omitted.

What I claim is:

1. An assembly for actuation of an openable closure lid, the assembly comprising a closure lid pivotally mounted about a fixed pivot axis for pivotal movement between a closed position and a raised open position;

a lever member having a lower end portion pivotally mounted about a fixed pivot axis and having an upper end portion;

an operating arm having a first end portion and a second end portion with said first end portion being pivotally connected to the upper end portion of the lever member;

stiff but resilient means interconnecting the closure lid and the operating arm for resiliently urging the operating arm relative to the closure lid in the direction of the second end portion of the operating arm during pivotal movement of the closure lid between the closed and open positions thereof; and a latch arm having an upper end portion and a lower end portion with said upper end portion of the latch arm being pivotally connected to the second end portion of the operating arm and with a latch member being presented by the lower end portion of the latch arm;

the lever member comprising a lower lever and an upper lever which is pivotally connected to the lower lever;

the levers having respective abutment portions which, in a limit condition of the levers, are in contact to limit relative pivotal movement between the levers in a direction in which the upper lever pivots relative to the lower lever away from the operating arm;

spring means acting between the levers resiliently to urge the levers towards said limit condition thereof;

the latch arm being pivotally connected to the closure lid at a spaced distance from the fixed pivot axis of the closure lid;

the latch member when the closure lid is in the closed position thereof being engageable with a fixed member adapted to be provided below the closure lid;

and a flexible member being connected to the lower lever for pivotal movement thereof about the fixed pivot axis of the lever member.

2. An assembly according to claim 1, wherein the latch member is adjustable relative to the latch arm from which the latch member is presented.

3. An assembly according to claim 1, wherein link means extends between the fixed pivot axis of the closure lid and the fixed pivot axis at the lower end portion of the lever member, the link means presenting support means adapted to bear against a fixed structure.

4. An assembly according to claim 1, wherein said resilient means comprises a stiff but resiliently deformable strip having a lower end which is fixedly connected to the closure lid and an upper end which is fixedly connected to the operating arm, the strip being resiliently deformed for said resilient urging of the operating arm relative to the closure lid in the direction of the second end portion of the operating arm during pivotal movement of the closure lid between the closed and open positions thereof.

5. An assembly according to claim 1, wherein at least one of the connections between the resilient means and the closure lid and operating arm is an adjustable connection.

* * * * *